US007775325B2

(12) United States Patent
Liebetrau et al.

(10) Patent No.: US 7,775,325 B2
(45) Date of Patent: Aug. 17, 2010

(54) DRIVE FOR AN ELEVATOR INSTALLATION AND METHOD OF CONVERTING A DRIVE IN AN ELEVATOR INSTALLATION

(75) Inventors: Christoph Liebetrau, Menziken (CH); Ruedi Stocker, Buchrain (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/037,406

(22) Filed: Jan. 18, 2005

(65) Prior Publication Data

US 2005/0220587 A1 Oct. 6, 2005

(30) Foreign Application Priority Data

Jul. 17, 2004 (EP) ..... 04016912
Dec. 28, 2004 (EP) ..... 04030856

(51) Int. Cl.
*B66B 11/08* (2006.01)

(52) U.S. Cl. ..... 187/254; 187/266; 187/414

(58) Field of Classification Search ..... 187/254, 187/266, 411, 412, 414; 29/428, 434; *B66B 7/06, B66B 11/08, 7/00*
See application file for complete search history.

(56) References Cited

U.S. PATENT DOCUMENTS

| | | | | |
|---|---|---|---|---|
| 276,784 | A * | 5/1883 | Daso | 187/266 |
| 2,217,285 | A * | 10/1940 | McKillop | 225/98 |
| 3,276,546 | A * | 10/1966 | Slais | 187/242 |
| 4,807,723 | A * | 2/1989 | Salmon et al. | 187/266 |
| 5,035,300 | A * | 7/1991 | Chapelain et al. | 187/266 |
| 5,076,398 | A * | 12/1991 | Heikkinen | 187/266 |
| 5,370,205 | A * | 12/1994 | Vanhala | 187/264 |
| 5,788,018 | A * | 8/1998 | Mendelsohn et al. | 187/404 |
| 5,957,242 | A * | 9/1999 | Suter et al. | 187/266 |
| 6,006,865 | A | 12/1999 | Ammon | |
| 6,223,862 | B1 * | 5/2001 | Barnes | 187/412 |
| 6,619,433 | B1 * | 9/2003 | Robert et al. | 187/251 |
| 7,077,241 | B1 * | 7/2006 | Liebetrau et al. | 187/266 |
| 7,559,409 | B2 * | 7/2009 | Barneman et al. | 187/408 |
| 7,624,847 | B2 * | 12/2009 | Liebetrau et al. | 187/266 |
| 7,681,692 | B2 * | 3/2010 | Fischer | 187/256 |
| 2002/0000346 | A1 | 1/2002 | Baranda et al. | |
| 2003/0155188 | A1 | 8/2003 | Cholinski et al. | |
| 2005/0006179 | A1 * | 1/2005 | Ach et al. | 187/254 |

FOREIGN PATENT DOCUMENTS

| | | |
|---|---|---|
| DE | 39 12 575 | 10/1989 |
| EP | 0 763 495 | 3/1997 |
| EP | 1 333 000 A | 8/2003 |
| EP | 1 338 550 | 8/2003 |

(Continued)

*Primary Examiner*—John Q Nguyen
*Assistant Examiner*—Stefan Kruer
(74) *Attorney, Agent, or Firm*—Fraser Clemens Martin & Miller LLC; William J. Clemens

(57) ABSTRACT

A modular drive for an elevator installation and a method of converting and fastening the drive in the elevator installation includes combining the main drive components such as a drive device, a brake device and a drive pulley into a drive module. Connecting parts for fastening the drive within an elevator shaft or in an engine space, or for adjusting a support means spacing, are mounted on the drive as required.

3 Claims, 9 Drawing Sheets

FOREIGN PATENT DOCUMENTS

| | | | | |
|---|---|---|---|---|
| JP | 07061744 | A | * | 3/1995 |
| JP | 09 151059 | A | | 6/1997 |
| JP | 2001171954 | | | 6/2001 |
| WO | WO 99/43597 | | | 9/1999 |
| WO | WO 01/28911 | | | 4/2001 |
| WO | WO 02/00541 | A | | 1/2002 |
| WO | WO 02/08108 | | | 1/2002 |
| WO | WO 02/26611 | A | | 4/2002 |
| WO | WO 02/079067 | | | 10/2002 |
| WO | WO 03/043927 | A2 | | 5/2003 |
| WO | WO 03043924 | A1 | * | 5/2003 |
| WO | WO 03/099696 | | | 12/2003 |

* cited by examiner

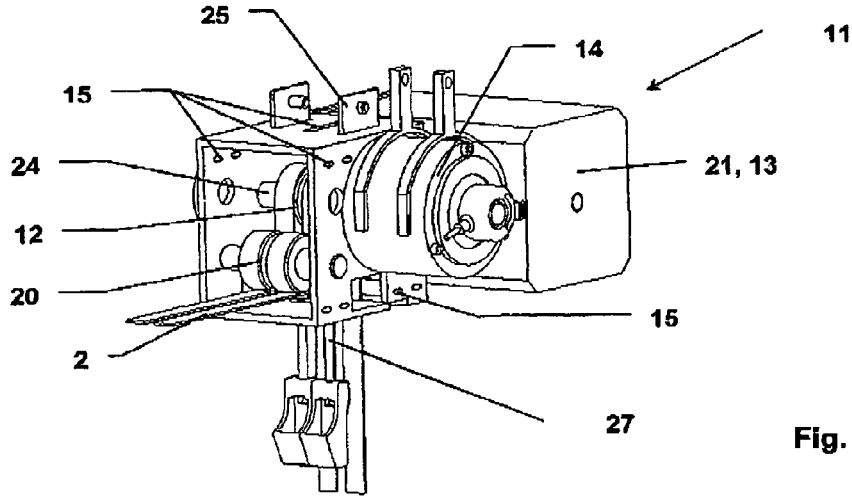
Fig. 4
Fig. 4b
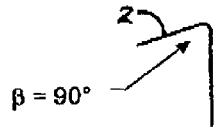
Fig. 4a
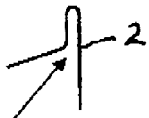
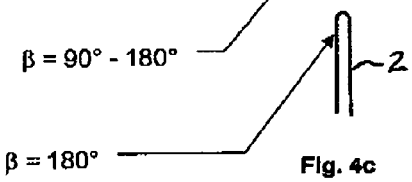
Fig. 4c
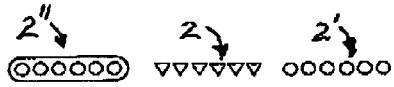
Fig. 4d Fig. 4e Fig. 4f
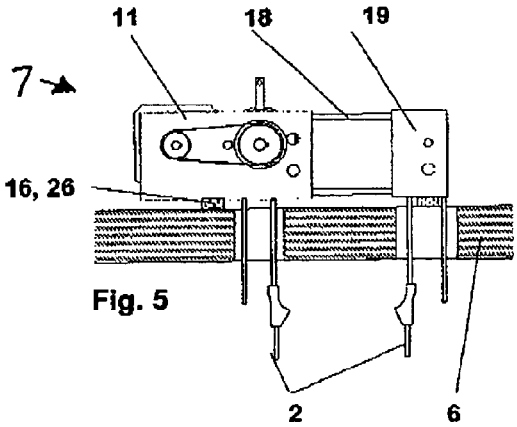
Fig. 5
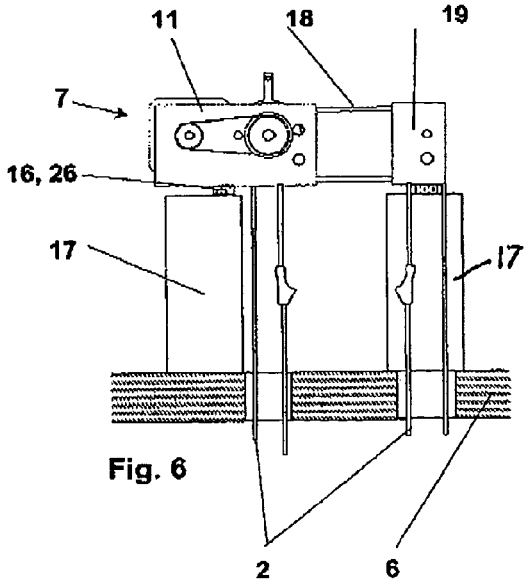
Fig. 6

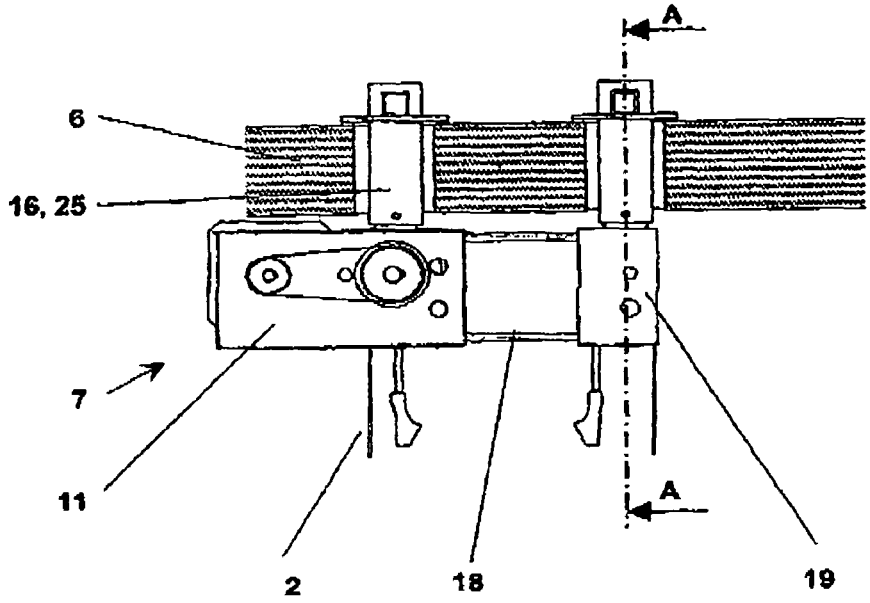
Fig. 7
Fig. 8
A - A
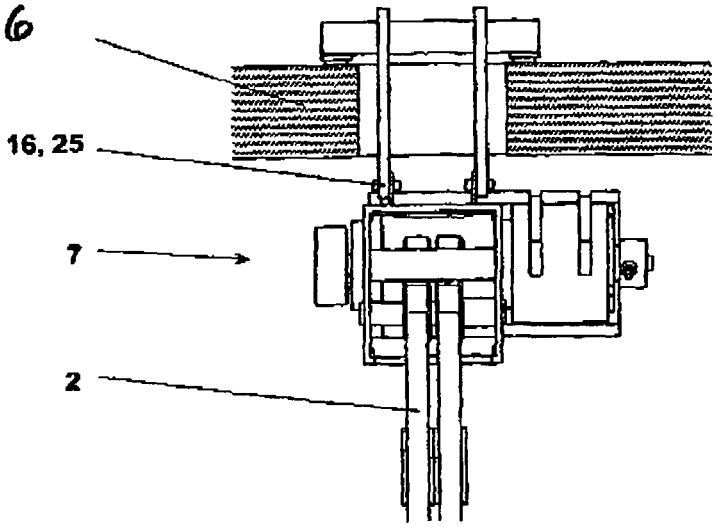

DRIVE FOR AN ELEVATOR INSTALLATION AND METHOD OF CONVERTING A DRIVE IN AN ELEVATOR INSTALLATION

BACKGROUND OF THE INVENTION

The present invention relates to an elevator installation with a modular drive and to a method for converting an elevator installation.

An elevator installation serves the purpose of transport of persons and goods within a building between floors. A car serves for reception of the persons and goods. A drive drives the car by means of a support means, the car thereby being moved back and forth in a vertically extending shaft. The support means connects the car with a counterweight. It is in that case guided by way of a drive pulley. The drive pulley transmits to the support means the force required for moving or stopping. The drive pulley is for that purpose driven or stopped by a drive device and/or a brake device.

Another type of drive drives the car by means of hydraulic elevatoring apparatus. The driving and stopping force is in that case transmitted to the car by a pump unit acting directly by way of a piston or acting indirectly by means of a cable or chain pull.

Both types of drive have specific use characteristics and in addition they are subject to wear. The use characteristics are, for example, the travel speed or the carry load for which the elevator installation is designed. Wear arises due to, for example, long-term utilization of the elevator installation which leads to wear phenomena at components of the elevator installation. If the use requirements change or if the wear is too great the drive, or if need be the entire elevator, has to be replaced or renewed.

In order to cover a widest possible field of use in the case of replacement of existing elevator drives or entire elevator installations with few components, universally or modularly usable drive engines are required.

Drives which are small and compact or enable variable support means take-offs are known. Thus, European patent specification EP 0 763 495 shows a drive engine which produces a change in the support means spacing (a) by changing the installation slope. The spacing between the support means run running up to the drive engine and the support means run running down is termed support means spacing. The illustrated drive engine has the disadvantage that it is fit to an engine space with specially made support pedestals and accordingly is not suitable for installation in an existing engine space or in a shaft, a change in the support means spacing (a) produces a change in the looping angle (β) and the unit is large, which has a disadvantageous effect in the case of installation in an existing building. The looping angle (β) denotes the angle by which the support means loop the drive pulley. The force transmissible from the drive pulley to the support means is usually dependent on the looping angle (β).

A drive engine which is of compact construction and can be mounted within the shaft space is shown in PCT specification WO 01/28911. The drive engine has a fixed support means spacing. The disadvantage of this solution is the lack of flexibility of the drive, since it does not allow any adjustment of the support means spacing.

SUMMARY OF THE INVENTION

An object of the present invention is to provide a drive for an elevator installation which is suitable for replacement of existing drives and which is adaptable in an optimum manner to existing buildings, i.e. it shall be able to be arranged in an existing engine space or within the shaft space without further measures. The support means spacing shall be adjustable in a simple manner and the drive shall have small dimensions. In addition, the drive shall be directly usable for elevator installations which are slung around, such as for elevator installations with direct 1:1 suspension. Obviously, general aspects such as a high safety standard, economic production and assembly as well as small dimensions are to be taken into consideration.

The elevator installation comprises a drive, a car held at support means and a counterweight. The car and the counterweight are arranged in a vertically extending shaft to be movable up and down in opposite direction. The support means connects the car with the counterweight and the support means is carried and driven by the drive by means of at least one drive pulley. The drive is provided with the drive pulley, with at least one motor required for driving the drive pulley and with a deflecting module. The motor and the drive pulley are combined to form a drive module. The core function of the drive is discernible through this drive module. As a rule the drive module similarly comprises a brake device.

According to the present invention the drive module and the deflecting module are connected together by means of an extension, wherein the drive module and the deflecting module are provided with interfaces which together with the extension enable adaptation of the drive to a required support means spacing. At the same time the drive module and/or the deflecting module is or are provided with connecting parts which are used for fastening the drive within the shaft or in the engine space.

By this solution the drive is adaptable in an optimum manner to existing buildings and it can—with use of the connecting part—be arranged without further constructional measures in an existing engine space or within a shaft. The support means spacing can be adapted in simple manner to predetermined support cable spacings with use of the extension and the interfaces at drive module and deflecting module. The modular construction of drive module and deflecting module as well as the fastening possibility thereof by means of suitable connecting parts makes small dimensions possible, since support forces are directly introduced into the building. The connecting parts are designed in correspondence with the building requirements. The drive module and the deflecting module have the appropriate interfaces. The parts can thereby be produced in rational manner and in large batch numbers. This gives optimum conditions of manufacture in terms of economy. Due to the division into module and parts the drive is easily transportable; it can, for example, be transported within an existing building, by an existing elevator installation, to the vicinity of the mounting location. It is thus particularly suitable for conversion of elevator installations in existing buildings. An advantageous consequence is similarly that the installation height of the drive, independently of support means spacing, is not changed and thus there is no dependence of the height space requirement on the support means spacing.

In an advantageous embodiment the drive module is provided with a guide roller. The guide roller is disposed in the drive module in such a manner that independently of the support means spacing it enables a fixedly defined looping of the drive pulley. Costly installation-related verifications of sufficient drive capacity are thereby redundant, since a few, fixedly defined looping angles can be taken into consideration for proof calculation. The drive module can thereby be manufactured particularly economically.

A fastening for attachment of support means ends is integrated in the drive module and/or the deflecting module. This fastening is advantageously used in the case of elevator installations with sling suspensions. All critical support points of the drive are thus placed in the drive itself. The entire suspension force of the elevator installation is accepted by the support points predetermined by the drive. The drive engine is thus particularly suitable for use in existing buildings, since the introduction of forces into the building is reduced to a few points. Advantageously a monitoring device monitoring correct transmission of the drive forces to the drive means is arranged in the drive module. An inadequate transmission of drive forces is established, for example, by comparison of the rotational speed of the guide roller with the rotational speed of the drive pulley. In the case of critical deviation, pre-defined safety measures are initiated. The safety and serviceability of the elevator installation is thereby increased, since the correct measures (maintenance request, shutdown, etc.) can be initiated specific to case.

DESCRIPTION OF THE DRAWINGS

The above, as well as other advantages of the present invention will become readily apparent to those skilled in the art from the following detailed description of a preferred embodiment when considered in the light of the accompanying drawings in which:

FIG. 4 is a perspective view of the drive module shown in FIGS. 2 and 3;

FIGS. 4*a* to 4*c* are schematic examples of slinging;

FIGS. 4*d* to 4*f* are schematic representations of different embodiments of support means;

FIG. 5 is an elevation view of a first example of installation of the modular drive according to the present invention mounted on a shaft roof;

FIG. 6 is an elevation view of a second example of installation of the modular drive according to the present invention mounted on a shaft roof;

FIG. 7 is an elevation view of a third example of installation of the modular drive according to the present invention mounted below a shaft roof;

FIG. 8 is a side view of the modular drive taken along the line A-A in FIG. 7;

DESCRIPTION OF THE PREFERRED EMBODIMENT

Figure 1:
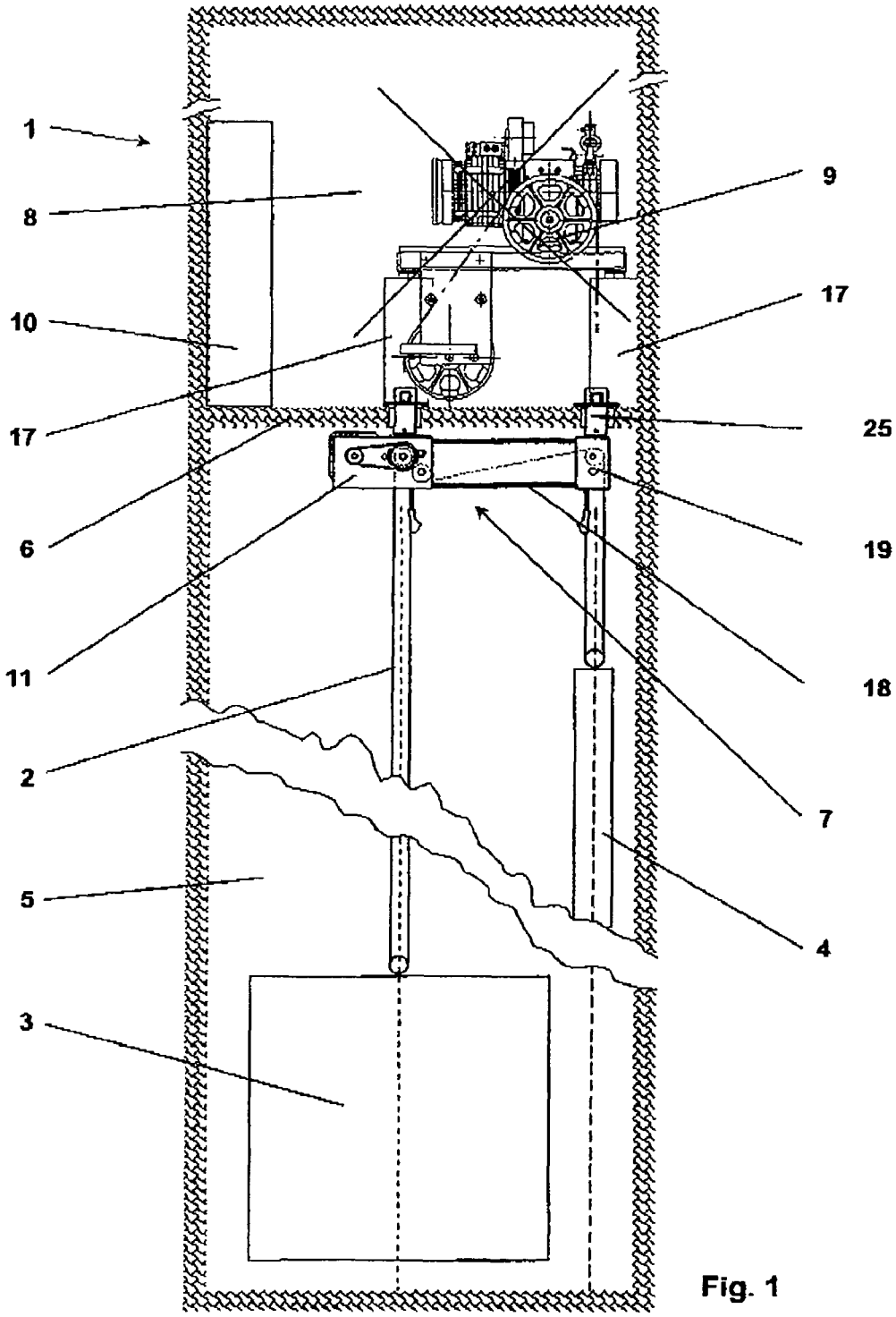
FIG. 1 is an elevation view of an example of an elevator installation with a modular drive according to the present invention, for possible use in the case of a drive conversion.

FIG. 1 shows an elevator installation 1 with a car 3 connected by a support means 2 with a counterweight 4, the car and the counterweight being movable up and down in opposite direction in a vertically extending shaft 5. A drive 7 according to the present invention mounted below a shaft roof 6 drives the support means 2, the car 3 and the counterweight 4. In the illustrated example, the existing elevator installation 1 with an engine space 8 is provided with the new drive 7. The original space required by an old drive engine 9 is no longer needed for the new drive 7. The old drive engine 9 can, as shown in the example, be left in the mounted state and demounted at a later point in time, or can be removed and the space 8 used for other tasks. A control 10 required for the new drive 7 can, as shown in the example, be arranged in the former engine space 8 or in the access region of a floor door or at another position, preferably in the vicinity of the drive 7.

Figure 2:
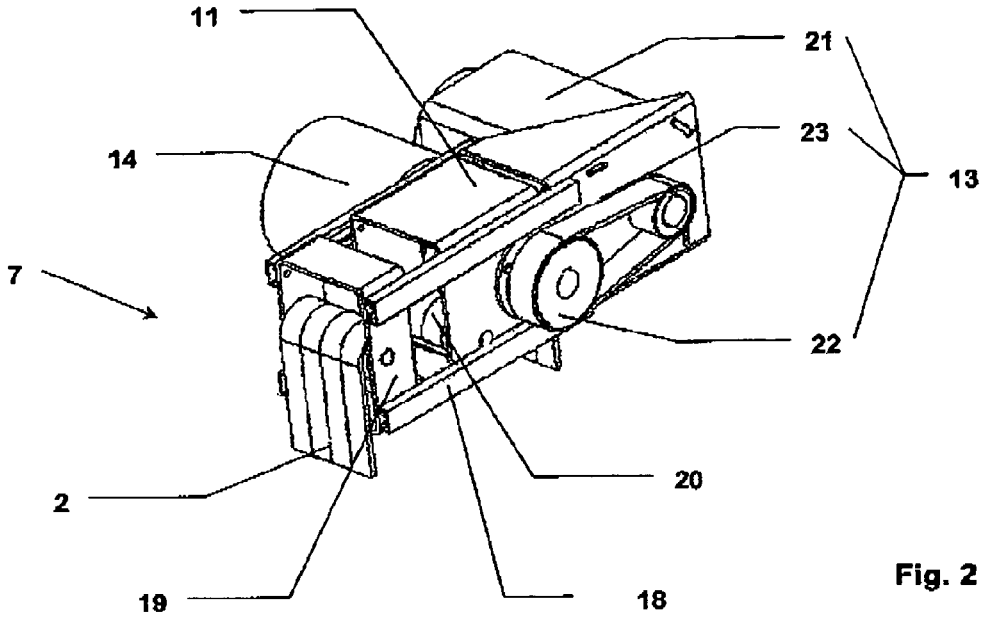
FIG. 2 is a perspective view of the modular drive shown in FIG. 1.
Figure 3:
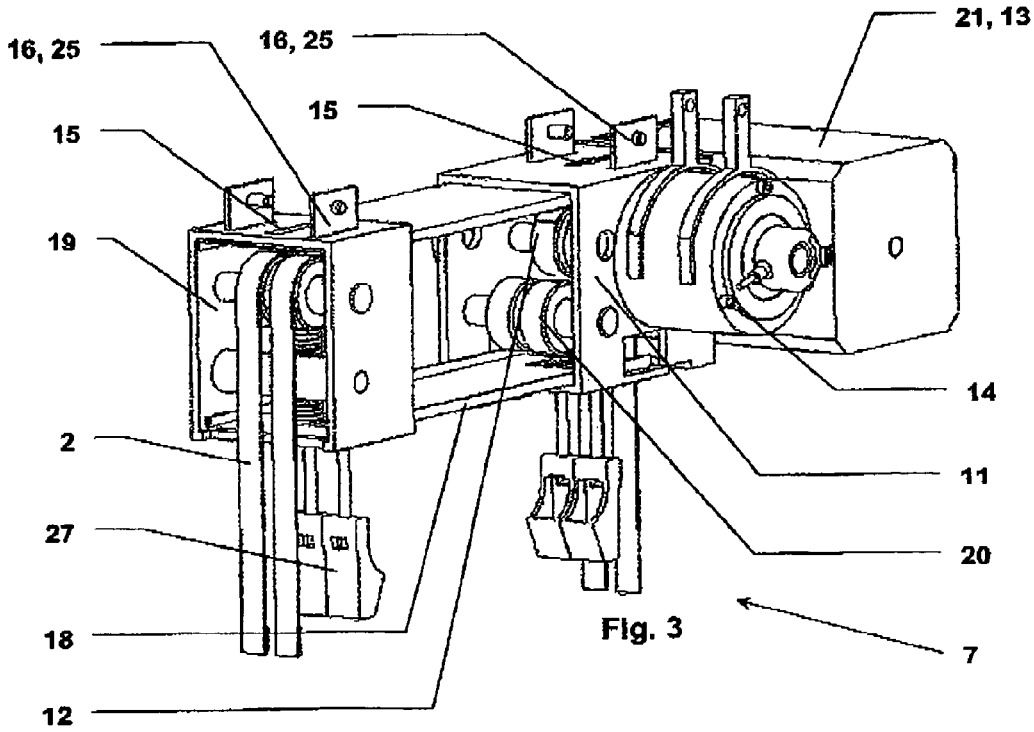
FIG. 3 is a perspective view of an opposite side of the modular drive shown in FIG. 2.

The new drive 7 is, as illustrated in FIGS. 2 and 3, of modular construction. A drive module 11 is provided with a drive pulley 12 for engaging the support means 2, with a motor 21 required for driving the drive pulley 12 and, in the illustrated example, with a brake device 14 required for braking the drive pulley 12. A drive device 13 and the drive pulley 12 are combined into the drive module 11 as illustrated in FIG. 4 by way of example. According to the present invention the drive module 11 is provided with interfaces 15. These interfaces 15 enable the connection of connecting parts 16. These connecting parts 16 selectably enable fastening of the drive module 11 within the shaft 5, for example to the shaft roof 6 as apparent in FIGS. 1, 7 and 8, or on the floor of a conventional engine space 8 as is illustrated in FIG. 5, or on pedestals 17 of the previously demounted old drive engine 9 as shown in FIG. 6.

The interfaces 15 moreover enable connection of an extension 18 to which a deflecting module 19 is connected as illustrated in FIGS. 1, 2 and 3. The extension 18 together with the drive module 11 and the deflecting module 19 enables adjustment of the support means spacing in correspondence with the requirements of the elevator installation 1. The deflecting module 19 in turn contains additional ones of the interfaces which enables connection of fastenings such as are used in the drive module 11.

The interfaces 15 of the drive module 11 and the interfaces 15 of the deflecting module 19 are preferably of identical construction. This enables simple mounting, since there is no possibility of mixing up when mounting the extension 18.

The extension 18 and the deflecting module 19 are constructed in such a manner that the constructional height of the drive 7 is not changed by the combination of the drive module 11, the extension 18 and the deflecting module 19. The interfaces 15 are designed appropriately to function. They enable a modular composition of the drive 7 according to the requirements of the building.

As an additional advantage the individual modules and parts can be separately transported to the mounting location. The transport units are thereby small and have a low individual weight. They can be transported in the shaft 5, for example, by an old elevator installation 9, which is intended for conversion, to the vicinity of the installation location in the building.

The advantage of this invention is to be recognized in the fact that this drive 7 is best suited for replacement of existing drives 9 in that it is adaptable in an optimum manner to existing buildings, i.e. it can be arranged not only within the shaft 5, but also in an existing engine space 8. The support means spacing is, in addition, adjustable in a simple manner. Adjustment of the support means spacing does not influence the constructional height of the drive.

As illustrated by way of example in FIG. 4, the drive module 11 is selectably provided with a guide roller 20 which ensures looping of the drive pulley 12 by the support means 2 independently of the support means spacing. If the support means 2 is deflected by use of the guide roller 20, the looping angle (β) amounts to 90° to 180°. This looping can be changed by the arrangement of the guide roller 20. A looping angle (β) in the vicinity of 180° is usually desired. The drive module 11 can also be used directly without employment of the guide roller 20. In that case a looping angle (β) of 90° or 180° results depending on the respective arrangement, as is illustrated in the basic sketches FIGS. 4*a*, 4*b* and 4*c*.

The advantage of this arrangement is to be recognized in that the looping angle (β) can be defined independently of the support means spacing.

Figure 14:
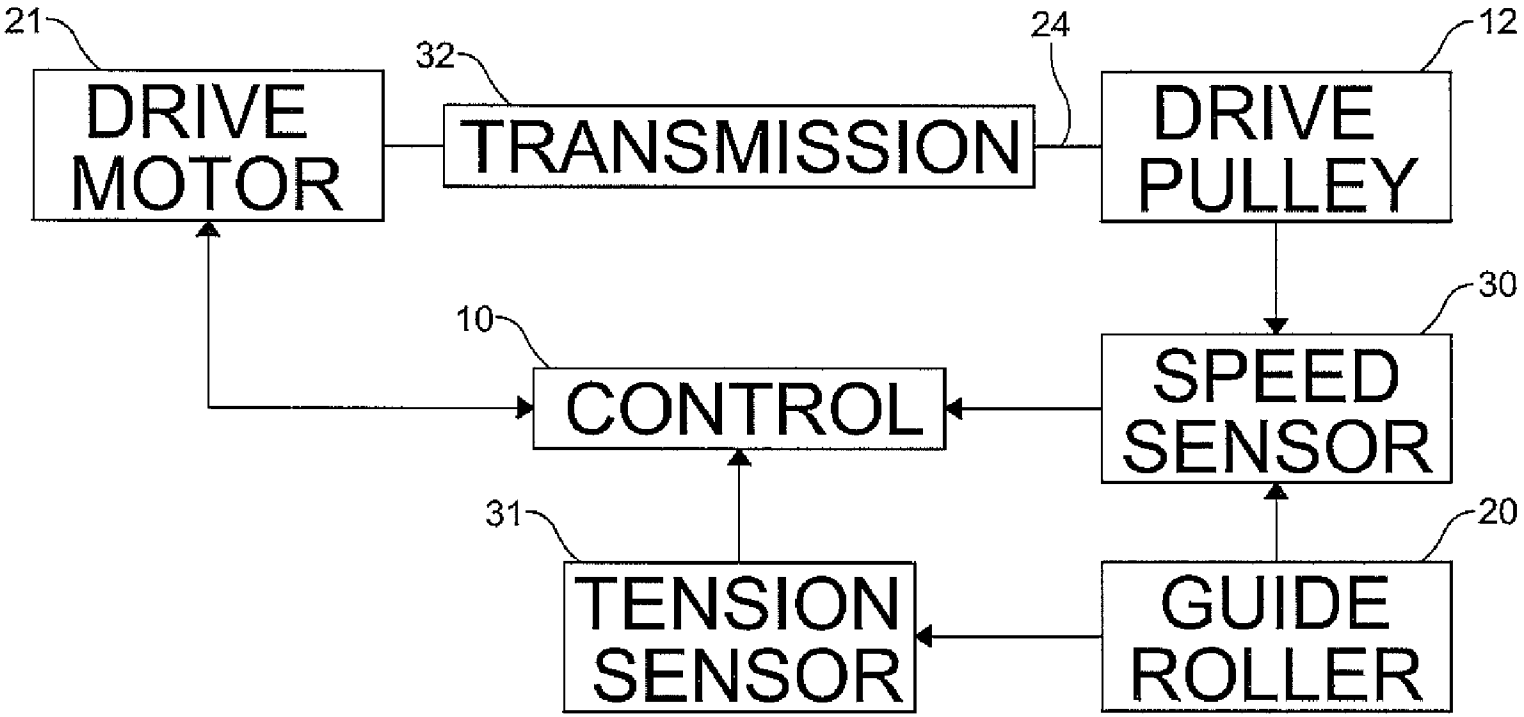
FIG. 14 is a block diagram of a system for monitoring the drive force transmission.

The drive module 11 is preferably provided with a monitoring device which monitors the correct drive force transmission from the drive pulley 12 to the support means 2 and/or the correct tension of the support means 2. The arrangement of the guide roller 20 illustrated in FIG. 4 enables checking of the drive force transmission in that, for example, the rotational speed of the guide roller 20 is compared with the rotational speed of the drive pulley 12. If the two values noticeably differ from one another an incorrect transmission of the driving forces is present. There is shown in FIG. 14 a speed sensor 30 (could be separate sensors) for monitoring the speeds of the drive pulley 12 and the guide roller 20 and sending this information to the control 10. Also, shown in FIG. 14 is a tension sensor 31 connected to the control 10 that can monitor the tension in the support means 2 by, for example, sensing the load on the guide roller 20.

The advantage of this construction is to be seen in that the correct transmission of the drive force can be monitored directly at the drive 7. The safety and serviceability of the elevator installation 1 is thereby increased, since the correct measures (maintenance request, shutdown, etc.) can be rapidly initialized specific to case.

The support means has, as illustrated in FIGS. 4*d* to 4*f*, a substantially round cross-section 2', or it has a substantially flat cross-section 2", wherein the surface serving for transmission of the drive force is smooth, longitudinally structured, toothed, nubbed, apertured, or of any other desired structure such as a V-shaped cross-section 2. The drive pulley 12 is constructed in such a manner that the transmission of the drive force from the drive pulley to the support means 2 is made possible appropriately to function.

The drive 7 is not limited to a specific support means 2. It is suitable for a plurality of support profile forms. It is advantageous if use is made of support means 2 which are suitable for small deflection radii. The drive 7 can thereby be of particularly small construction.

Figure 11:
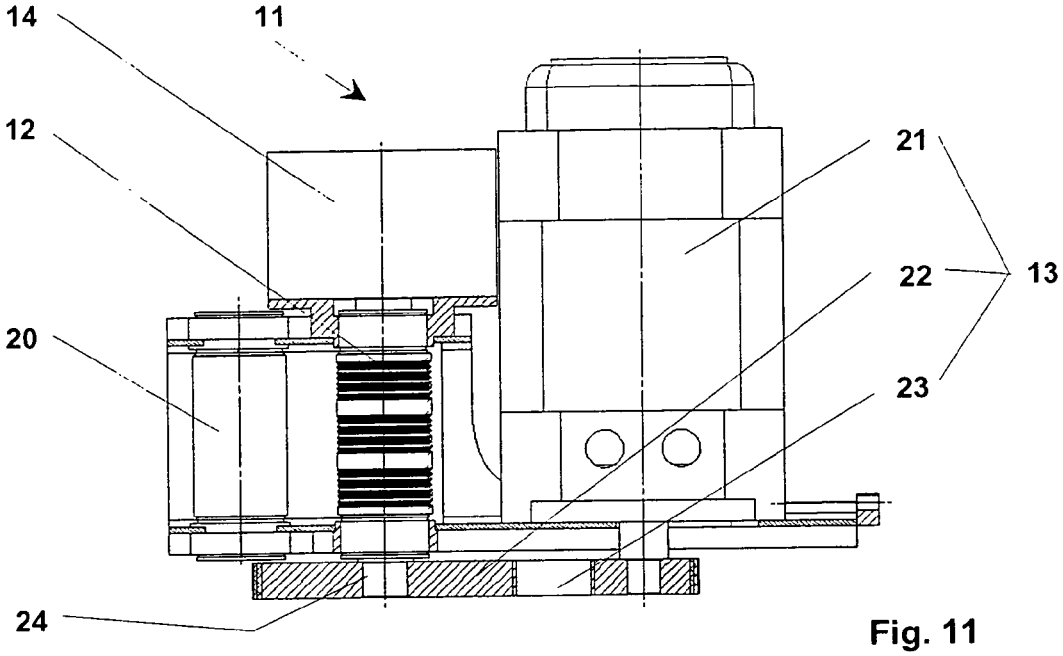
FIG. 11 is a cross-sectional schematic view of the drive module with a belt connection.

In an advantageous embodiment of the drive 7 according to the present invention the motor 21 of the drive module 11 is, as illustrated in FIG. 11, arranged axially parallel to the drive pulley 12, wherein the motor 21 is connected by a drive belt 23 with a belt pulley 22 arranged coaxially with the drive pulley 12. This embodiment requires little constructional space in the width of the drive 7 and the transmission of the drive moment takes place with low vibration.

Alternatively, the motor 21 is arranged directly coaxially with the drive pulley 12. The advantage of this alternative is to be seen in that the constructional length of the drive 7 is reduced.

In a further alternative the motor 21 is connected with a drive pulley shaft 24 by a transmission 32 as shown in FIG. 14. The advantage of this alternative lies in the use of commercially available translation equipment.

Figure 12:
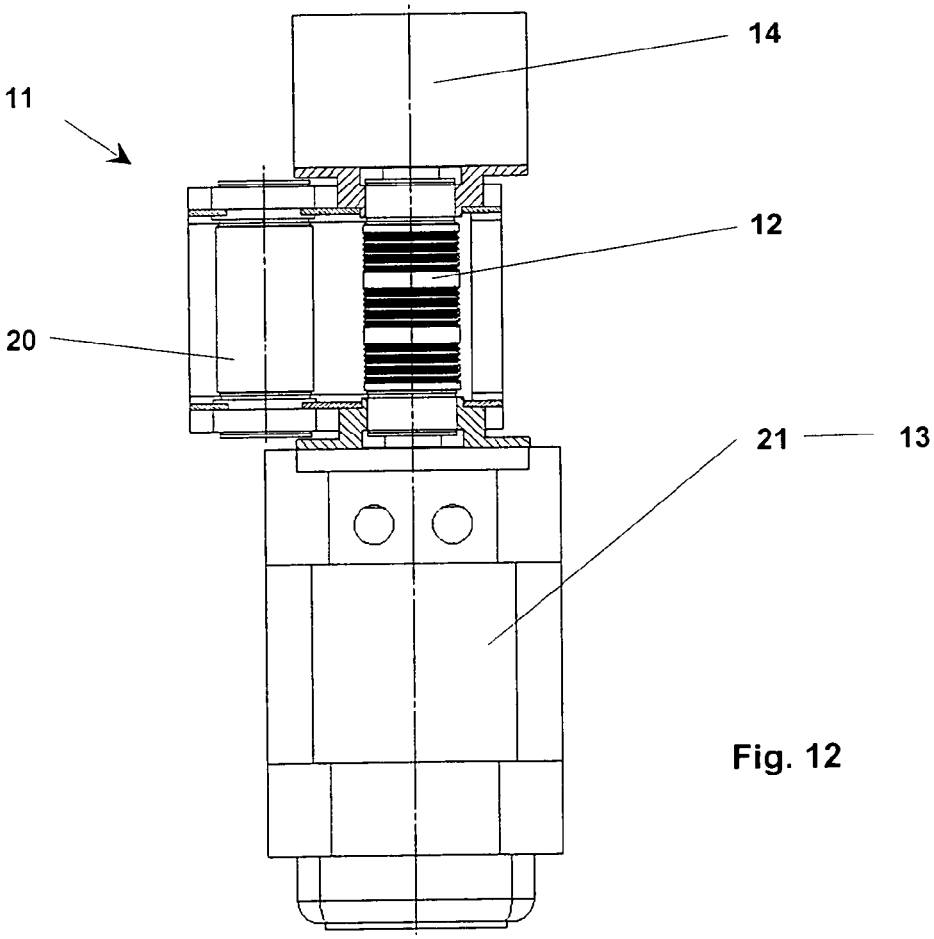
FIG. 12 is a cross-sectional schematic view of the drive module with a directly connected drive device.

As illustrated in FIGS. 11 and 12, the brake device 14 is advantageously arranged to act directly on the drive pulley shaft 24 or the drive pulley 12. This arrangement significantly reduces the risk of brake failure, since the braking force is introduced directly into the drive pulley 12. The advantage of this arrangement is that a safety-compliant brake system for stopping and holding the car 3 with intact support means 2 can be economically realized. Alternatively, the brake device 14 is arranged to act directly on the shaft of the drive motor 21. This arrangement is favorable in costs, since the brake device 14 with a low brake moment can be used. This arrangement usually requires further safety measures, which are known on the market, in order to cope with failure of the connection of the drive motor 21 with the drive pulley shaft 24. Alternatively, the brake device 14 or a further brake device can be arranged on the deflecting module 19.

Advantageously the drive pulley 12 and/or the drive pulley shaft 24 and/or the belt pulley 22 is or are of integral construction. This embodiment enables a production-optimized and economic construction of the drive module 11.

The drive module 11 is provided with the interfaces 15 which enable attachment of the several connecting parts. The advantage of this embodiment results from the universal usability of the drive module 11. The interfaces 15 enable attachment of the connecting parts required for the specific elevator installation 1. The interfaces 15 are, as apparent in FIGS. 3, 4, 9 and 10, for example slots or hole arrangements or clamping jaws for reception of connecting means. The connecting parts are, selectably, the extension 18, the deflecting module 19, suspension or support modules 25, 26, or there are support means end connections 27 or further auxiliary means. The construction of the drive module 11 with the interfaces 15 appropriate to function enables utilization of the drive module 11 for many kinds of elevators and this enables a rational and economic manufacture of the product.

A first advantageous connecting part is the extension 18, which is arranged with one end region at the interface 15 of the drive module 11, and to the other end region of which the deflecting module 19 is fastened. The deflecting module 19 comprises an interface 15 identical to the drive module 11. By means of the extension 18 and the design of the interface 15 for the drive module 11 and the deflecting module 19 there is made possible an adaptation of the drive 7 to the requisite support means spacing. Existing elevator installations 1 have a specific form of suspension of the car 3 or of the counterweight 4. Resulting from this form of suspension is a characterizing spacing of the support means run, which usually extends from the center of the car 3 in vertical projection to the center of the counterweight 4. The advantage of the extension 18 is that adjustment of the support means spacing is possible. Thus, universal drive and deflecting modules can be used, which in turn enables efficient manufacture of the drive. The deflecting module 19 and the drive module 11 have the same interfaces 15. This is particularly advantageous, as design possibilities are thereby increased. Thus, for example, two of the drive modules 11 can be used instead of the arrangement of the drive module 11 and the deflecting module 19. The power of the drive system 7 can thereby be significantly increased.

Figure 9:
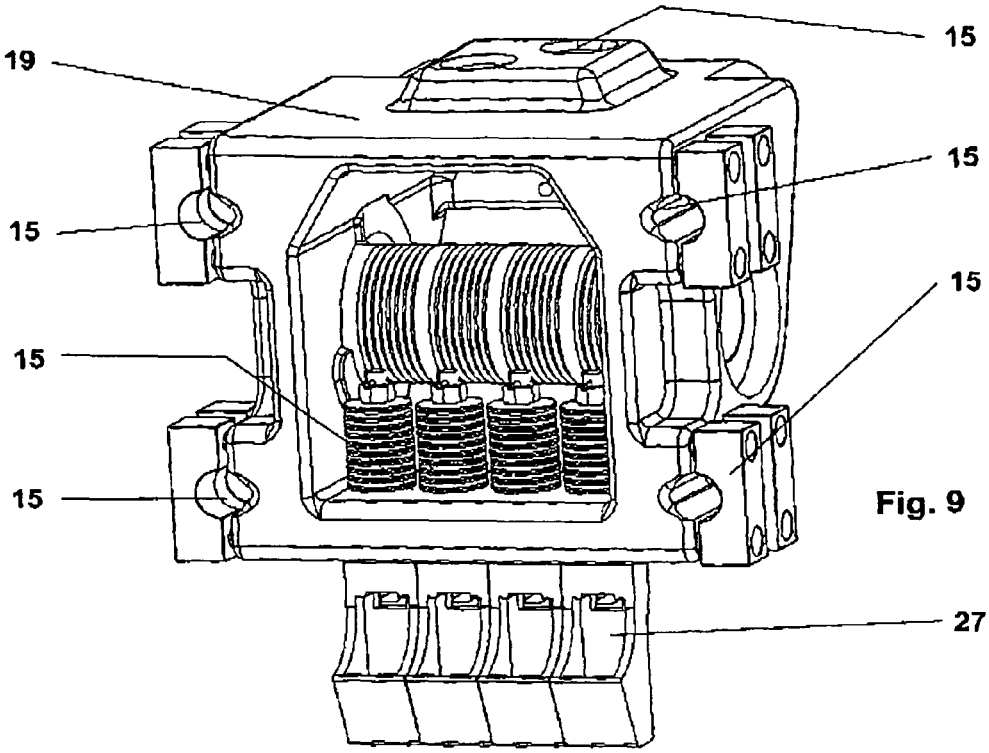
FIG. 9 is a perspective view of a first example of a deflecting module according to the present invention.
Figure 10:
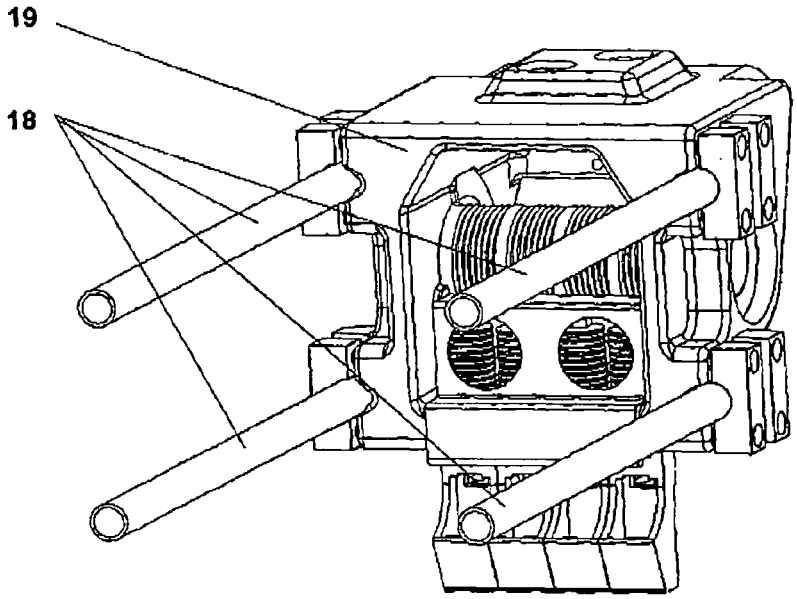
FIG. 10 is a perspective view of a second example of a deflecting module with extensions according to the present invention.

In particular embodiments, the end region of the extension 18 is received by the interface 15 of the drive module 11. The end region of the extension 18 is releasably connected to the interface 15 of the drive module 11 to permit a fine adjustability and slidable movement of the drive module 11 with the extension 18. The other end region of the extension 18 is received by the interface 15 of the deflecting module 19. The other end region of the extension 18 is releasably connected to the interface 15 of the deflecting module 19 to permit a fine adjustability and slidable movement of the deflecting module 19 with the extension 18. The end region of the extension 18 is releasably connected to the drive module 11, and the other end region of the extension 18 is releasably connected to the deflecting module 19, through the respective interfaces 15 with fasteners as known in the art. As shown in FIGS. 9 and 10, the interface 15 may include clamping jaws. The extension 18 may be disposed in the aperture between one of the clamping jaws and one of the drive module 11 and the deflecting module 19. The clamping jaws are caused to press against the extension 18 through a tightening of the fasteners in the clamping jaws, thereby causing a friction fit between the extension 18 and the interfaces 15. It should be appreciated that the clamping jaws may also be loosened in order to slide at least one of the drive module 11 and the deflection module 19 toward or away from each other, as required for the desired elevator installation.

The interfaces 15 of the drive module 11 and of the deflecting module 19 for the extension 18 enable a fine adjustability of the support means spacing. This advantageous embodiment allows adjustment to the actually present support means spacing. There is thus no skewed traction, whereby wear of the support means 2 is reduced.

A further advantageous connecting part 16 is the suspension module 25, which is arranged at the interface 15 of the drive module 11 and/or of the deflecting module 19 and which enables suspension of the drive at the shaft roof 6, or another connecting part 16 is the support module 26 (FIGS. 5 and 6), which is arranged at the interfaces 15 of the drive module 11 and/or of the deflecting module 19 and which enables fastening of the drive 7 in the engine space 8 or to a shaft wall. The suspension or support modules 25, 26 are advantageously provided with noise-damping or vibration-damping materials. The advantage of this embodiment is to be seen in that a fastening appropriate to the type of building can be used.

The suspension module 25 uses, for example, existing openings in the shaft roof 6 or in the floor of the engine space 8 disposed above in order to suspend the drive 7 at the shaft roof 6, wherein the counter-plates required in the engine space 8 are constructed to be long and narrow and are arranged between the existing engine pedestals 17. Depending on the form of the engine space 8 the counter-plates can have other shapes, as necessary for the arrangement. They can in case of the need be constructed to be, for example, round.

It is particularly advantageous with this embodiment that any of the engine pedestals 17 which were used for fastening an old drive 9 can be left. This reduces conversion time and the costs connected therewith.

The drive module 11 and/or the deflecting module 19 is or are advantageously provided with the support means end connections 27. It is of advantage in that case that the interfaces relative to the building are reduced, since all supporting forces from the car 3 and the counterweight 4 are led to the drive unit and are introduced by way of the suspension points of the drive 7 into the building. The arrangement of the suspensions enables use of a 2:1 slung arrangement in the case of elevator installations 1 which were suspended in the old construction directly, or 1:1. This arrangement is made possible by a particularly advantageous design of the support means end connections.

Figure 13:
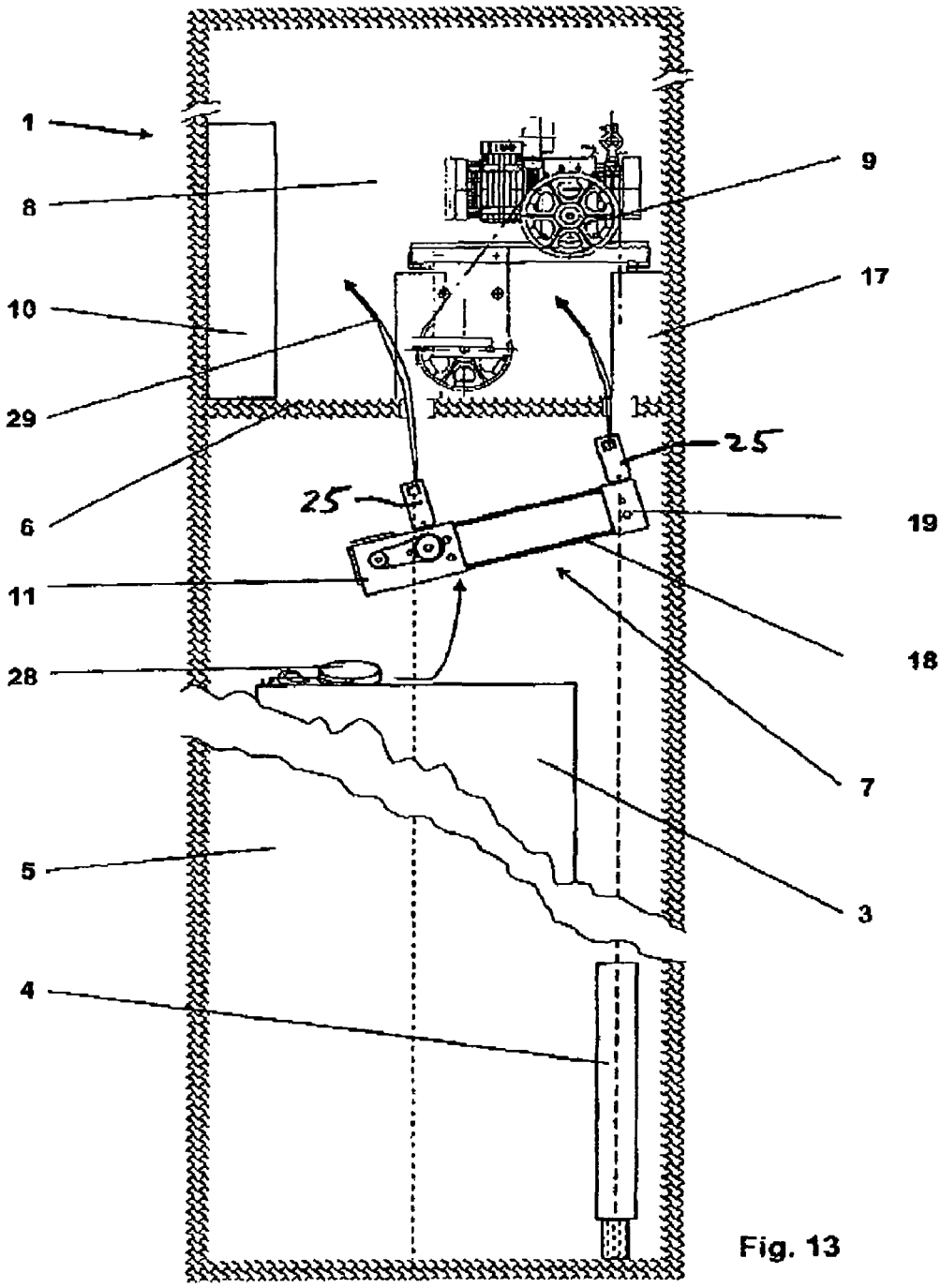
FIG. 13 is an elevation view of a method of mounting the modular drive according to the present invention.

In a useful enhancement the drive module 11 and/or the deflecting module 19 is or are provided with an interface 15 for fastening an auxiliary hoist 28. The auxiliary hoist 28 serves for the movement, which is needed for mounting, of elevator material and/or assembly personnel. This enhancement allows a particularly efficient course of mounting of the drive 7 according to the invention, as illustrated in FIG. 13 by way of example.

The drive according to the present invention is transported with the help of the old elevator installation 1 to the vicinity of the installation location and completed there with the necessary connecting parts 16. The old car 3 is now fixed and secured in the vicinity of the uppermost stop and the old support elements are demounted. The drive 7 according to the present invention is now raised to the shaft roof 6, preferably with use of the already existing cable passages and traction equipment 29 mounted in the engine space 8, and fastened by means of the suspension module 25. An auxiliary hoist 28 is now mounted at the interface 15 provided at the drive 7. With the help of this auxiliary hoist 28 the car 3 can now be moved and any components of the old engine space equipment, such as the drive engine 9, the control boxes 10, etc., can be transported with the help of the auxiliary hoist 28. If the renewal of the rest of the shaft equipment is replaced in accordance with a respective conversion agreement, the new support means 2 can be put in, the auxiliary hoist 28 can be removed and the elevator installation 1 is after a short conversion time again available for the customer. This outlined sequence of conversion is merely one possible example. It demonstrates the advantageous use of the drive 7 according to the present invention.

A supplementary embodiment proposes that the fastening of the support means end connection 27 is provided with monitoring means for ascertaining the support means tension. The advantage of this embodiment is that in the case of deviation of the support means tension suitable measures can be initiated, such as, for example, a request for a service engineer or shutdown of the elevator installation 1 before an unsafe operating state arises.

The control 10 belonging to the elevator and/or drive regulation is or are advantageously arranged in the engine space 8. Alternatively, it can also be arranged entirely or partly in the shaft 5 or at a readily accessible location, preferably in the vicinity of the drive.

In the case of conversion of existing elevator installations 1 the engine space 8 is often present. The engine space 8 cannot as a rule be used for other purposes. Thus, use of the engine space 8 is available for arrangement of the new control 10 and/or drive regulation. The electrical connection to the drive 7 is usually possible in a simple manner via existing passages in the shaft roof 6. It is particularly advantageous in that case that the existing engine space 8 is usefully re-employed. The best arrangement of the control 10 and/or the drive regulation can be selected in dependence on the existing arrangement or possibility of use of the engine space 8.

Figure 15A:
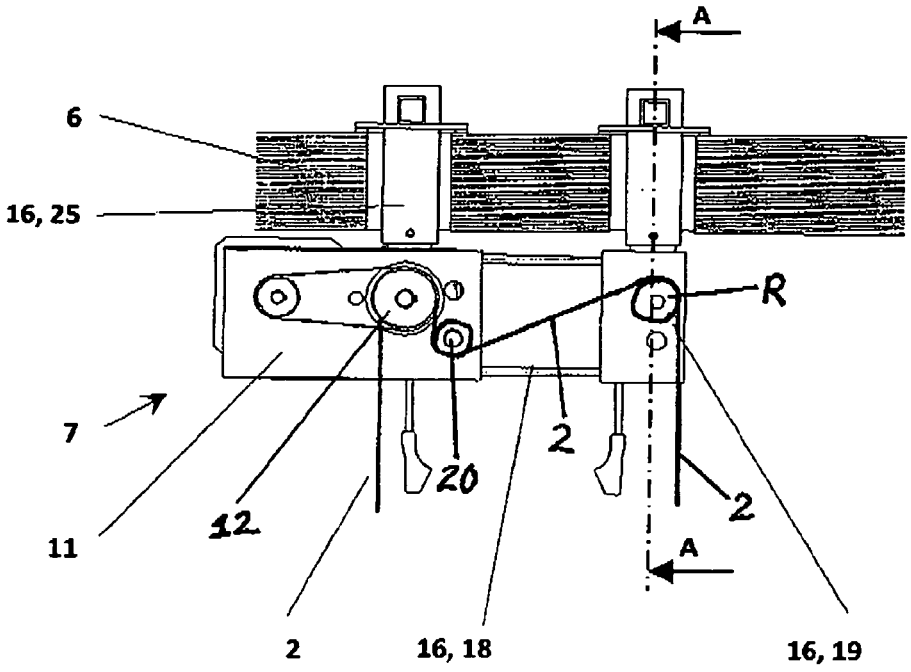
FIG. 15*a* is a schematic view of a first path of the support means through the modular drive shown in FIG. 7.

FIG. 15*a* is a view similar to FIG. 7 with the housings of the drive module 11 and the deflecting module 19 broken away to show a first path of the support means 2 through the modular drive 7. The support means 2 enters the drive module 11 from that car 3 below (FIG. 1) and wraps approximately 180° around the drive pulley 12 before being redirected by the guide roller 20 toward the deflecting module 19. The support means 2 extends at an upward angle from the guide roller 20 and around a deflecting roller R in the deflecting module 19 to exit in a downward direction to the counterweight 4 (FIG. 1).

The illustrated forms of embodiment and methods are examples. Combinations are possible. Thus, for example, the illustrated drive module 11 and deflecting module 19 can also be used individually.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of converting an existing elevator installation comprising the steps of:

a. providing a drive module including a drive device rotatably driving a drive pulley for engaging a support means, the drive module further having interfaces with apertures;

b. providing a deflecting module including a deflecting roller for engaging the support means, the deflecting module further having interfaces with apertures;

c. providing an extension having opposed free ends for connecting said drive module to said deflecting module, said at least one extension configured to maintain said drive module spaced from said deflecting module along said at least one extension, where at least one of the interfaces of the drive module and the deflecting module has a releasable connection permitting a fine adjustability and movement of said drive module, said deflecting module and said at least one extension relative to one another while connected together;

d. providing connecting parts for fastening said drive module and said deflecting module individually and directly to one of a wall of the shaft, a roof of the shaft and a surface in an engine space of the elevator installation, wherein the connecting parts include one of a suspension module and a support module, the suspension module enabling a suspension of the drive below the shaft roof utilizing openings in the shaft roof, and the support module enabling a fastening of the drive at one of the engine space and an upper surface of the shaft roof;

e. assembling a modular drive at an existing elevator installation by inserting the extension into the apertures to releasably connect the drive module to the deflecting module, and adjusting the interfaces relative to the extension to adapt the modular drive to a required support means spacing; and f. fastening the drive module and the deflecting module individually and directly to one of a shaft wall, a roof of the shaft and an engine space of the elevator installation with the connecting parts.

2. The method according to claim 1 including the step of mounting the modular drive on the support modules above the roof of the shaft.

3. The method according to claim 1 including the step of mounting the modular drive on the suspension modules below the roof of the shaft.

* * * * *